US009459589B2

(12) United States Patent
Bühler et al.

(10) Patent No.: US 9,459,589 B2
(45) Date of Patent: Oct. 4, 2016

(54) ONE-PIECE DOUBLE BALANCE SPRING AND METHOD OF MANUFACTURING THE SAME

(75) Inventors: Pierre-André Bühler, Orvin (CH); Marco Verardo, Les Bois (CH); Thierry Conus, Lengnau (CH); Jean-Philippe Thiebaud, Cudrefin (CH); Jean-Bernard Peters, La Chaux-de-Fonds (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 1722 days.

(21) Appl. No.: 12/408,130

(22) Filed: Mar. 20, 2009

(65) Prior Publication Data

US 2009/0236782 A1 Sep. 24, 2009

(30) Foreign Application Priority Data

Mar. 20, 2008 (EP) ..... 08153094

(51) Int. Cl.
*G04B 17/04* (2006.01)
*G04B 17/06* (2006.01)
*G04D 3/00* (2006.01)

(52) U.S. Cl.
CPC ..... *G04B 17/066* (2013.01); *G04D 3/0041* (2013.01); *Y10T 29/49609* (2015.01)

(58) Field of Classification Search
CPC ..... G04B 17/066; G04D 3/0041; Y10T 29/49609
USPC ..... 267/151, 272, 154, 273, 285; 368/175–178
See application file for complete search history.

(56) References Cited

U.S. PATENT DOCUMENTS 3,553,956 A * 1/1971 Schwartz et al. ..... 368/158
3,599,423 A * 8/1971 Beguin et al. ..... 368/171

(Continued)

FOREIGN PATENT DOCUMENTS

EP 0 732 635 A1 9/1996
EP 0911707 A1 4/1999

(Continued)

OTHER PUBLICATIONS

SuitbertW; "Basel 2007—Moser's New Double Straumann Hairspring Escapement," Apr. 12, 2007, printed from http://basel.watchprosite.com/show-nblog.post/ti-360412/ on Nov. 6, 2008, XP002502705.

(Continued)

*Primary Examiner* — Vishal Sahni
(74) *Attorney, Agent, or Firm* — Oblon, McClelland, Maier & Neustadt, L.L.P

(57) ABSTRACT

The invention relates to a double balance spring (21) including, made in a layer of silicon-based material (11), a first balance spring (23) coaxially mounted on a collet (13, 27), the collet (13, 27) including an extending part (9) that projects from said balance spring and which is made in a second layer of silicon-based material (5). According to the invention, said extending part extends (17) into a third layer (7) of silicon-based material coaxially with a second balance spring (25) so as to form a one-piece double balance spring (21) made of silicon-based materials. The invention also relates to a timepiece including a balance spring of this type and the method of manufacturing the same. The invention concerns the field of timepiece movements.

21 Claims, 4 Drawing Sheets

(56) References Cited

U.S. PATENT DOCUMENTS

| | | | | |
|---|---|---|---|---|
| 7,077,562 | B2 | 7/2006 | Bourgeois et al. | |
| 7,213,966 | B2 | 5/2007 | Lambert et al. | |
| 2002/0180130 | A1 | 12/2002 | Baur et al. | |
| 2004/0174775 | A1 | 9/2004 | Muller | |
| 2005/0219957 | A1 | 10/2005 | Lambert et al. | |
| 2005/0281137 | A1 | 12/2005 | Bourgeois et al. | |
| 2006/0055097 | A1 * | 3/2006 | Conus et al. | 267/273 |

FOREIGN PATENT DOCUMENTS

| | | | |
|---|---|---|---|
| EP | 1 422 436 | A1 | 5/2004 |
| EP | 1 584 994 | A1 | 10/2005 |
| EP | 1 655 642 | A2 | 5/2006 |
| EP | 1 837 722 | A2 | 9/2007 |
| FR | 2 447 571 | A1 | 8/1980 |
| GB | 2039389 | * | 8/1980 |
| WO | 2006/123095 | A2 | 11/2006 |

OTHER PUBLICATIONS

European Search Report issued in corresponding application No. EP08153094, completed Nov. 6, 2008.

Austrian Search Report issued in corresponding Singapore application No. 200901887-0, mailed Nov. 16, 2009.

* cited by examiner

ONE-PIECE DOUBLE BALANCE SPRING AND METHOD OF MANUFACTURING THE SAME

FIELD OF THE INVENTION

The invention concerns a double balance spring and the method of manufacturing the same and, more specifically, a double balance spring formed in a single piece.

BACKGROUND OF THE INVENTION

The regulating member of a timepiece generally includes an inertia wheel, called a balance, and a resonator called a balance spring. These parts have a determining role as regards the working quality of the timepiece. Indeed, they regulate the movement, i.e. they control the frequency of the movement.

In the case of a double balance spring, materials have been tested in order to limit the influence of a temperature change on the regulating member in which it is integrated, without resolving difficulties regarding assembly or resonance adjustment.

SUMMARY OF THE INVENTION

It is an object of the present invention to overcome all or part of the aforecited drawbacks, by providing a double, one-piece balance spring whose thermo-elastic coefficient can be adjusted and which is obtained using a manufacturing method that minimises assembly difficulties.

The invention therefore concerns a double balance spring that includes, made in a layer of silicon-based material, a first balance spring coaxially mounted on a collet, the collet including one extending portion that projects from said balance spring and which is made in a second layer of silicon-based material, characterized in that said extending portion extends into a third layer of silicon-based material coaxially with a second balance spring in order to form a one-piece, double balance spring made of silicon-based materials.

According to other advantageous features of the invention:

- the collet has approximately the same section in each of said layers so as to facilitate adjustment of said double balance spring;
- the collet has an approximately different section over at least one of the layers,
- the balance springs include coils that wind in the same direction or pitch,
- the ends of the outer curves of each of the balance springs are plumb with each other so that single means can be used for pinning said double balance spring up to the collet,
- the balance springs have the same angular stiffness or pitch,
- at least one of the balance springs has at least one part made of silicon dioxide to make it more mechanically resistant and to adjust its thermo-elastic coefficient,
- the inner coil of at least one of the balance springs has a Grossmann curve so as to improve the concentric development of said coil,
- the collet has a metal part into which an arbour is driven.

More generally, the invention relates to a timepiece, characterized in that it includes a double balance spring in accordance with any of the preceding variants.

Finally, the invention relates to a method of manufacturing a double balance spring that includes the following steps:

a) providing a substrate including a top layer and a bottom layer of silicon-based materials,
b) selectively etching at least one cavity in the top layer to define the pattern of a first part of a collet, made of silicon-based material, of said double balance spring,
c) joining an additional layer of silicon-based material to the etched top layer of the substrate,
d) selectively etching at least one cavity in the additional layer to continue the pattern of the collet and to define the pattern of a first balance spring, made of silicon-based material, of said double balance spring, characterized in that it further includes the following steps:

selectively etching at least one cavity in the bottom layer to continue the pattern of the collet and to define the pattern of a second balance spring, made of silicon-based material, of said double balance spring, releasing the double balance spring from the substrate.

According to other advantageous features of the invention:

- after step d), it includes step g): oxidising the first balance spring made of silicon-based material so as to make it more mechanically resistant and to adjust its thermo-elastic coefficient,
- after step e), it includes step g'): oxidising the second balance spring made of silicon-based material so as to make it more mechanically resistant and to adjust its thermo-elastic coefficient,
- prior to step e), it includes step h): selectively depositing at least one metal layer on the bottom layer to define the pattern of a metal part on the collet,
- step h) includes step i): growing said deposition by successive metal layers at least partially over the surface of the bottom layer, so as to form the metal part for receiving an arbour, which is driven therein,
- step h) includes steps j): selectively etching at least one cavity in the bottom layer for receiving the metal part and step k): growing said deposition by successive metal layers at least partially in said at least one cavity so as to form the metal part into which an arbour will be driven,
- step h) includes a last step I): polishing the metal deposition,
- several double balance springs are made on the same substrate, which allows batch manufacture.

BRIEF DESCRIPTION OF THE DRAWINGS

Other peculiarities and features will appear more clearly from the following description, which is given by way of non-limiting illustration, with reference to the annexed drawings, in which.

DETAILED DESCRIPTION OF PREFERRED EMBODIMENTS

The invention relates to a method, generally designated 1, for manufacturing a double balance spring 21 for a timepiece movement. As illustrated in FIGS. 1 to 9, method 1 includes successive steps for forming at least one type of one-piece, double balance spring, which can be entirely formed of silicon-based materials.

Figure 1:
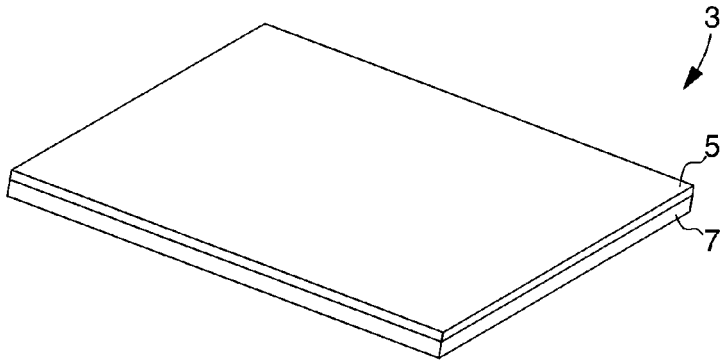
FIGS. 1 to 5 show successive view of the manufacturing method according to the invention.
Figure 9:
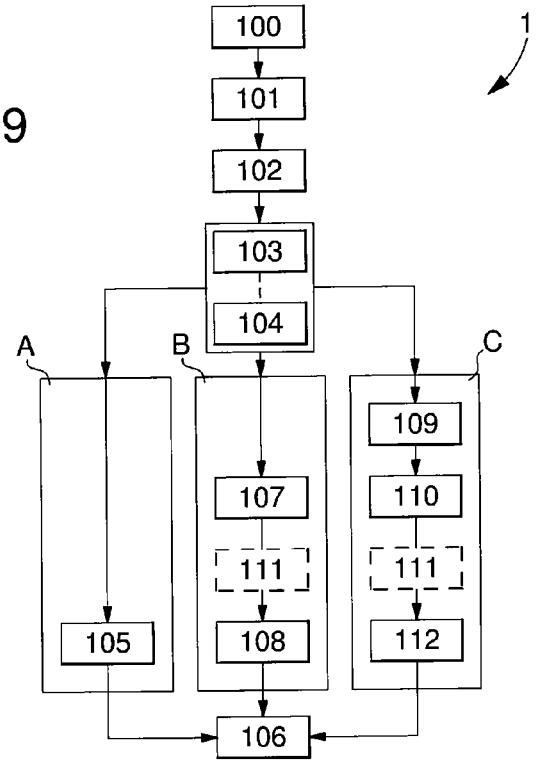
FIG. 9 shows a flow chart of the method according to the invention.

With reference to FIGS. 1 and 9, the first step 100 consists in providing a silicon-on-insulator (SOI) substrate 3. Substrate 3 includes a top layer 5 and a bottom layer 7 each formed of silicon-based material.

Preferably, in this step 100, substrate 3 is selected such that the height of bottom layer 7 matches the height of one part of the final double balance spring 21.

Preferably, top layer 5 is used as spacing means relative to bottom layer 7. Consequently, the height of top layer 5 will be adapted in accordance with the configuration double balance spring 21. Depending upon said configuration, the thickness of top layer 5 may thus fluctuate, for example, between 10 and 200 μm.

Figure 2:
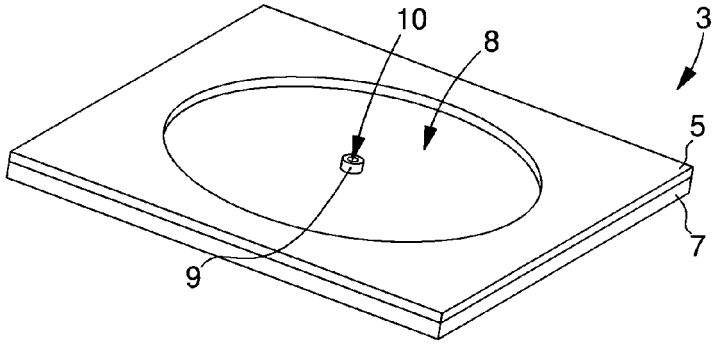

In a second step 101, seen in FIG. 2, cavities 8 and 10 are selectively etched, for example by a DRIE (deep reactive ionic etch) process, in top layer 5 of silicon-based material. These cavities 8 and 10 can preferably form a pattern 9 that defines the inner and outer contours of one part of the collet, made of silicon-based material, of the double balance spring.

Figure 10:
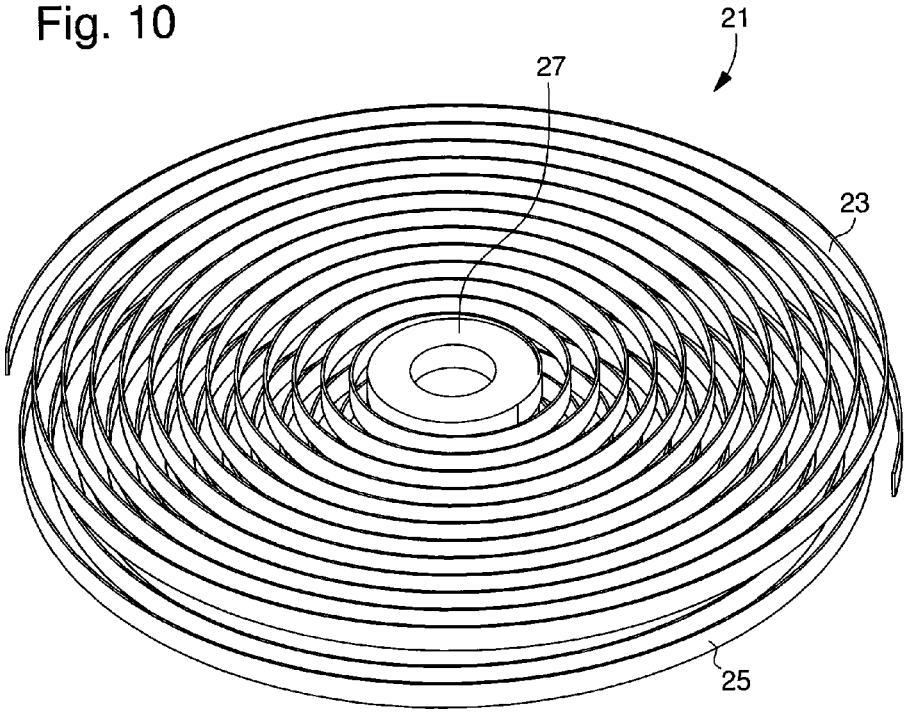
FIGS. 10 and 11 are perspective diagrams of a one-piece, double balance spring according to a first embodiment.
Figure 11:
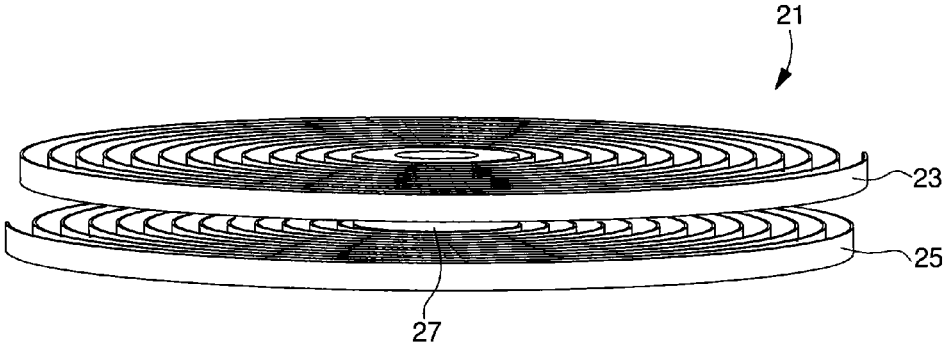

In the example illustrated in FIGS. 10 and 11, pattern 9 forms the median part of collet 27 of double balance spring 21. As FIG. 2 illustrates, pattern 9 is approximately cylinder-shaped with a circular section. However, advantageously according to method 1, the etch on the top layer 5 leaves complete freedom as regards the geometry of pattern 9. Thus, it might not necessarily be circular, but, for example, elliptical and/or have a non-circular inner diameter.

Figure 3:
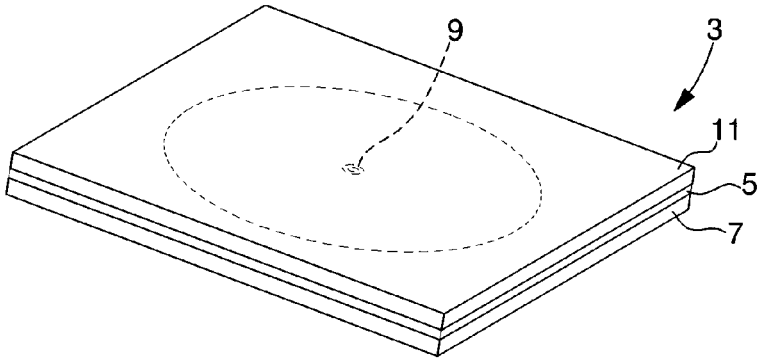

In a third step 102, shown in FIG. 3, an additional layer 11 of silicon-based material is added to substrate 3. Preferably, additional layer 11 is secured to top layer 5 by means of silicon fusion bonding (SFB). Thus, step 102 advantageously covers top layer 5 by binding the top face of pattern 9, with a very high level of adherence, to the bottom face of additional layer 11. Additional layer 11 may, for example, have a similar thickness to that of bottom layer 7.

Figure 4:
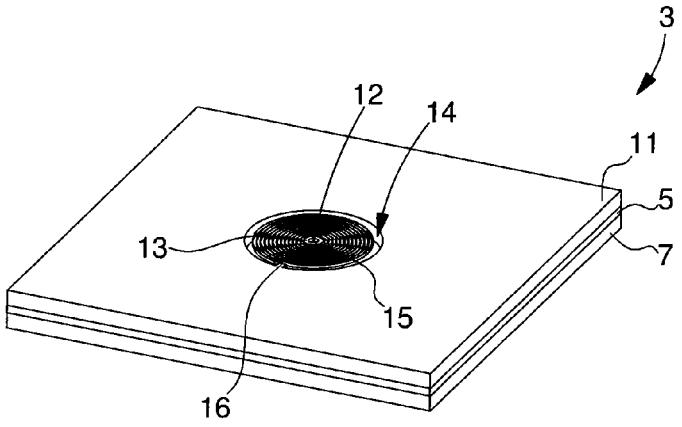

In a fourth step 103, shown in FIG. 4, cavities 12 and 14 are selectively etched, for example, by a DRIE process similar to that of step 101, in additional silicon layer 11. These cavities 12 and 14 form two patterns 13 and 15, which define the inner and outer contours of the silicon parts of double balance spring 21.

In the example illustrated in FIG. 4, pattern 13 is approximately cylindrical with a circular section, and pattern 15, is approximately spiral-shaped. However, advantageously according to method 1, the etch on additional layer 11 allows complete freedom for the geometry of patterns 13 and 15. Thus, in particular, pattern 15 may, for example, include more coils or an open outer curve.

Preferably, pattern 13 made in additional layer 11 is of similar shape and plumb with pattern 9 made in top layer 5. This means that cavities 10 and 12, respectively forming the inner diameter of patterns 9 and 13, communicate with each other and are substantially one on top of the other. In the example illustrated in FIGS. 10 and 11, patterns 13 and 9 respectively form the upper and median parts of collet 27 of double balance spring 21.

Preferably, at least one bridge of material 16 is formed to hold double balance spring 21 on substrate 3 during manufacture. In the example illustrated in FIG. 4, it can be seen that a bridge of material 16 is left between the outer curve of pattern 15 and the rest of the non-etched layer 11.

Advantageously, as patterns 13 and 15 are etched at the same time, they form a one-piece part in additional layer 11. In the example illustrated in FIGS. 10 and 11, patterns 13 and 15 form respectively the top part of collet 27 and the first balance spring 23 of double balance spring 21.

After this fourth step 103, it is clear that patterns 13 and 15 etched in additional layer 11 are connected by the bottom of pattern 13, with a high level of adherence, above pattern 9, which is etched in top layer 5 and laterally, by the outer curve of pattern 15, to additional layer 11.

Preferably, as shown in dotted lines in FIG. 9, method 1 can include a fifth step 104 that consists in oxidising at least pattern 15, i.e. the first balance spring 23 of the double balance spring so as to make said first balance spring more mechanically resistant and to adjust its thermo-elastic coefficient. This oxidising step is explained in EP Patent No. 1 422 436 and its US equivalent, U.S. Pat. No. 7,077,562, which is incorporated herein by reference.

Advantageously, according to the invention, after fourth step 103, or preferably, after fifth step 104, method 1 may include three embodiments A, B and C, as illustrated in FIG. 9. However, each of the three embodiments A, B and C ends in the same final step 106, which consists in releasing the manufactured double balance spring 21 from substrate 3.

Advantageously, release step 106 can be achieved simply by applying sufficient force to double balance spring 21 to break bridges of material 16. This force may, for example, be generated manually by an operator or by machining.

Figure 5:
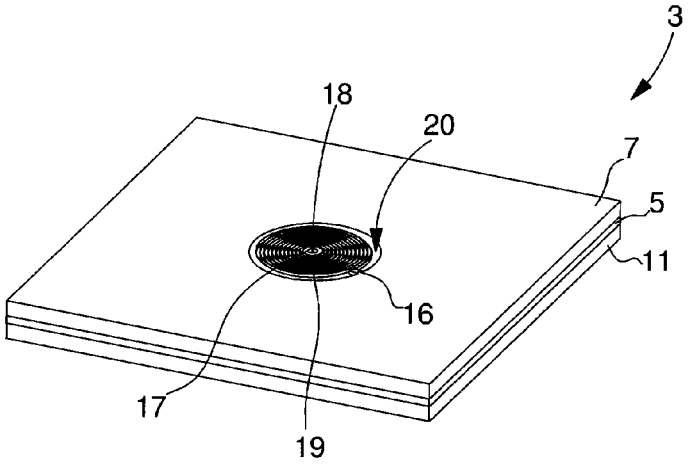

According to a first embodiment A, in a sixth step 105, shown in FIG. 5, cavities 18 and 20 are selectively etched, for example by a similar DRIE process to that of steps 101 and 103, in bottom layer 7 of silicon-based material. These cavities 18 and 20 form two patterns 17 and 19, which define the inner and outer contours of silicon parts of double balance spring 21.

In the example illustrated in FIG. 5, pattern 17 is approximately cylinder-shaped with a circular section and pattern 19 is approximately spiral-shaped. However, advantageously according to method 1, the etch in bottom layer 7 leaves complete freedom as to the geometry of patterns 17 and 19. Thus, in particular, pattern 19 may, for example, have more coils or an open outer curve.

Preferably, pattern 17, made in bottom layer 7, is of similar shape and substantially plumb with pattern 9 made in top layer 5. This means that cavities 18, 10 and 12 respectively forming the inner diameters of patterns 17, 9 and 13, communicate with each other and are approximately one on top of the other. In the example illustrated in FIGS. 10 and 11, patterns 13, 9 and 17 form the one-piece collet 27 of double balance spring 21.

Preferably, at least a second bridge of material 16 is formed to hold double balance spring 21 on substrate 3 during manufacture. The example illustrated in FIG. 5 shows that one bridge of material 16 is left between the outer curve of pattern 19 and the rest of the non-etched layer 7.

Advantageously, as patterns 17 and 19 are etched at the same time, they form a one-piece part in bottom layer 7. In the example illustrated in FIGS. 10 and 11, patterns 17 and 19 form respectively the bottom part of collet 27 and the second balance spring 25 of double balance spring 21.

After this sixth step 105, it is clear that patterns 17 and 19 etched in bottom layer 7 are connected by the top of pattern 17, with a high level of adherence, above pattern 9, which is etched in top layer 5 and, laterally, by the outer curve of pattern 19 to bottom layer 7.

After final step 106, explained above, first embodiment A thus produces a one-piece double balance spring 21, formed entirely of silicon-based materials, as shown in FIGS. 10 and 11. It is thus clear that there are no longer any assembly problems, since assembly is performed directly during manufacture of double balance spring 21. The latter includes a first balance spring 23 and a second balance spring 25, which are joined coaxially to each other by a single collet 27.

As explained above, collet 27 is formed by the three successive patterns 13, 9 and 17 by etching the successive respective layers 11, 5 and 7. It is thus clear that median pattern 9 is useful as spacing means between the first balance spring 23 and the second balance spring 25, but also as guide means for said balance springs. Advantageously, according method 1, it is thus possible, via the choice of thickness of top layer 5, to define directly the space between the two balance springs 23 and 25 and the guide quality thereof.

Similarly, the height of balances springs 23, 25 and, incidentally, those of top and bottom parts 13 and 17 of collet 27, which are not necessarily equal, can be directly defined by the choice of thickness of additional layer 11 and bottom layer 7.

Moreover, the etches carried out in steps 103 and 105 of method 1 allow complete freedom as to the geometry of balance springs 23, 25 and collet 27. Thus, in particular, each balance spring 23 and 25 can have its own number of coils, its own geometrical features in proximity to collet 27, its own coil winding direction and also its own curve geometry, particularly as regards the external part. By way of example, one and/or the other of balance springs 23, 25 can thus have an open outer curve so as to cooperate with an index assembly or have, on the end of the outer curve, a bulge portion that can be used as a point of attachment.

In accordance with the same reasoning, collet 27 can have uniformly peculiar or different dimensions and/or geometries at least over one of bottom 17, median 9 and/or top 13 parts. Indeed, depending upon the arbour on which collet 27 will be mounted, the inner diameter can have a complementary shape over all or part of the height of collet 27. Likewise, the inner and/or outer diameters are not necessarily circular but may be, for example, elliptical and/or polygonal.

In the example illustrated in FIGS. 10 and 11, balance springs 23 and 25 have the same height, i.e. they are etched in layers 7 and 11 of the same thickness and they have the same number of coils. The ends of their outer curve are shifted relative to the collet by an angle of approximately 180°. Finally, the coils of balance springs 23 and 25 have opposite winding directions. Moreover, collet 27 is of entirely uniform height and it is approximately cylinder-shaped with a circular section.

As explained above, because of the manufacturing freedom allowed by method 1, things could be different, i.e. the ends of the outer curve of each balance spring 23, 25 could be plumb with each other which would advantageously enable single means to be used for pinning the two balance springs 23 and 25 up to the collet.

It should also be noted that the very good structural precision of deep reactive ionic etching decreases the start radius of each of balance springs 23 and 25, i.e. the external diameter of collet 27, which means that the internal and external diameters of collet 27 can be miniaturised. It is thus clear that double balance spring 21 can advantageously receive, via its cavities 18, 10 and 12, an arbour of smaller diameter than is currently usually manufactured.

Preferably, said arbour can be secured to the internal diameter 18 and/or 10 and/or 12 of collet 27. Tightening can be achieved using resilient means etched in silicon collet 27. Such resilient means may, for example, take the form of those disclosed in FIGS. 10A to 10E of EP Patent No. 1 655 642 and its US equivalent, U.S. Publication No. 2006/055, 097, or those disclosed in FIGS. 1, 3 and 5 of EP Patent No. 1 584 994 and its US equivalent, U.S. Pat. No. 7,213,966, said patents being incorporated herein by reference.

Figure 6:
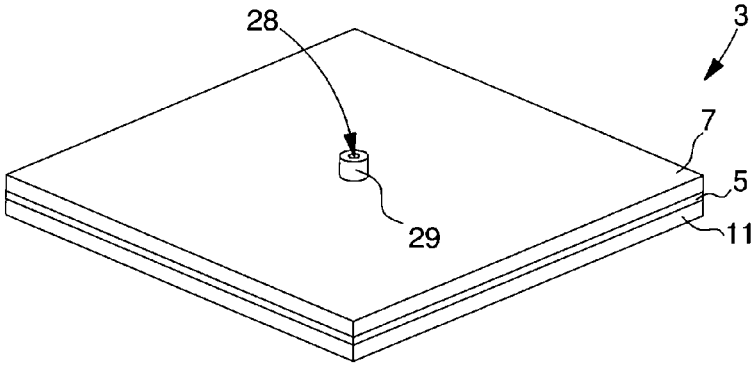
FIGS. 6 to 8 show views of the successive steps of alternative embodiments.

According to a second embodiment B, after step 103 or 104, method 1 includes a sixth step 107, shown in FIG. 6, consisting in implementing a LIGA process (from the German "röntgenLthographie, Galvanoformung & Abformung"). This process includes a series of steps for electroplating a metal on the bottom layer 7 of substrate 3 in a particular shape, using a photostructured resin. As this LIGA process is well known, it will not be described in more detail here. Preferably, the metal deposited may be, for example, gold or nickel or an alloy of these metals.

In the example illustrated in FIG. 6, step 107 may consist in depositing a cylinder 29. In the example illustrated in FIG. 6, the cylinder 29 is for receiving an arbour, which is advantageously driven therein. Indeed, one drawback of silicon is that it has very few elastic and plastic zones, making it very brittle. The invention thus proposes to fit an arbour, for example a balance staff, not against the silicon of collet 27, but to the inner diameter 28 of metal cylinder 29, which is electroplated during step 107.

Advantageously, according to method 1, the cylinder 29 obtained by electroplating allows complete freedom as regards its geometry. Thus, in particular, the inner diameter 28 is not necessarily circular, but for example polygonal, which could improve the transmission of stress in rotation with an arbour of matching shape.

In a seventh step 108, similar to step 105 shown in FIG. 5, cavities are selectively etched, for example by a DRIE method, in bottom layer 7 of silicon-based material. These cavities allow patterns to be formed for a second balance spring and a collet similar to patterns 19 and 17 of the first embodiment A.

After final step 106, explained above, the second embodiment B thus produces a one-piece, double balance spring formed of silicon-based materials with the same advantages as embodiment A, with the addition of a metal part 29. It is thus clear that there is no longer any assembly problem since assembly is carried out directly during manufacture of the double balance spring. Finally, advantageously, an arbour can be driven against the inner diameter 28 of metal part 29. One could therefore envisage cavities 10 and 12 including sections of larger dimensions than that of inner diameter 28 of metal part 29, so as to prevent the arbour being in push fit contact with collet 27.

Figure 7:
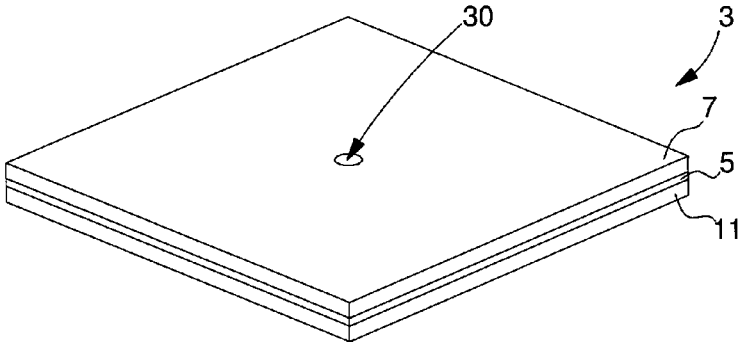

According to a third embodiment C, after step 103 or 104, method 1 includes a sixth step 109 shown in FIG. 7, consisting in selectively etching a cavity 30, for example, by a DRIE process, to a limited depth in bottom layer 7 of silicon-based material. Cavity 30 forms a recess to be used as a container for a metal part. As in the example illustrated in FIG. 7, the cavity 30 obtained can take the form of a disc. However, advantageously according to method 1, the etch of bottom layer 7 allows complete freedom as to the geometry of cavity 30.

Figure 8:
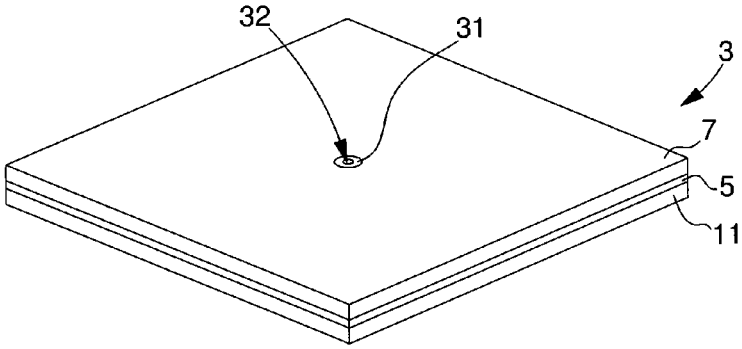

In a seventh step 110, as illustrated in FIG. 8, method 1 includes implementation of a galvanic growth or LIGA process for filling cavity 30 in accordance with a particular metal shape. Preferably, the deposited metal may be, for example, gold or nickel.

In the example illustrated in FIG. 8, step 110 may consist in depositing a cylinder 31 in cavity 30. Cylinder 31 is for receiving an arbour, which is advantageously driven therein. Indeed, as explained above, one advantageous feature of the invention consists in tightening the arbour, for example the balance staff, not against the silicon-based material of collet 27, but on the inner diameter 32 of metal cylinder 31, which is electroplated during step 110.

Advantageously according to method 1, cylinder 31 obtained by electroplating allows complete freedom as to its geometry. Thus, in particular, the inner diameter 32 is not necessarily circular but, for example, polygonal, which could improve the transmission of stress in rotation with an arbour of matching shape.

Preferably, method 1 includes an eighth step 111, consisting in polishing the metal deposition 31 made during step 110, in order to make said deposition flat.

In a ninth step 112, similar to step 105 shown in FIG. 5, cavities are selectively etched, for example, by a DRIE process, in bottom layer 7 of silicon-based material. These cavities form patterns of a second balance spring and a collet similar to patterns 19 and 17 of the first embodiment A.

After final step 106 explained above, third embodiment C produces a one-piece, double balance spring formed of silicon-based materials with the same advantages as embodiment A, with the addition of a metal part 31. It is thus clear that there are no longer any assembly problems, since assembly is carried out directly during manufacture of the double balance spring. Finally, advantageously, an arbour can be driven against inner diameter 32 of the metal part. One could therefore preferably envisage cavities 10 and 12 including sections of larger dimensions than that of the inner diameter 32 of metal part 31, to prevent the arbour being in push fit contact with collet 27.

According to the three embodiments A, B and C, it should be understood that the final double balance spring 21 is thus assembled prior to being structured, i.e. prior to being etched and/or altered by electroplating. This advantageously minimises the dispersions generated by current assemblies of two balance springs and, consequently, improves the precision of a regulator member on which it will depend.

Advantageously, according to the invention, it is also clear that it is possible for several double balance springs 21 to be made on the same substrate 3, which allows batch production.

Moreover, it is possible to make a driving insert of the same type as metal depositions 29 and/or 31 also, or solely from additional layer 11 and/or top layer 5. One could also envisage the two balance springs 23 and 25 being oxidised to make them more mechanically resistant and to adjust their thermo-elastic coefficient. A conductive layer could also be deposited on at least one part of double balance spring 21 to prevent isochronism problems. This layer may be of the type disclosed in EP Patent No. 1 837 722 and its U.S. equivalent, U.S. Pat. No. 7,824,097, which is incorporated herein by reference. Finally, a polishing step like step 111 may also be carried out between step 107 and step 108 as shown in dotted lines in FIG. 9.

What is claimed is:

1. A one-piece double balance spring, made from a three layer silicon based material by a method comprising the steps of:

(i) providing a silicon material having first and second layers;

(ii) etching a central collet portion in the second layer;

(iii) securing a third layer on the second layer;

(iv) etching a first balance spring having a first collet portion in the first layer of silicon-based material so that the first collet portion is coaxially mounted on the central collet portion; and (v) etching a second balance spring having a second collet portion in the third layer of silicon-based material so that the second collet portion is coaxial with the central collet portion, thereby forming the one-piece double balance spring, wherein the first collet portion, the second collet portion and the central collet portion form a single collet wherein the central collet portion is a spacing means defining a space between the first balance spring and the second balance spring.

2. The one-piece double balance spring according to claim 1, wherein the single collet has a similar section in each of the first, second and third layer portions of which it is respectively comprised.

3. The one-piece double balance spring according to claim 1, wherein the single collet has a substantially different section across at least one of the first, second and third layer portions of which it is respectively comprised.

4. The one-piece double balance spring according to claim 1, wherein the first and second balance springs include coils wound in a same direction.

5. The one-piece double balance spring according to claim 1, wherein the first and second balance springs include coils wound in different directions.

6. The one-piece double balance spring according to claim 1, wherein ends of outer curves of each of the first and second balance springs are aligned vertically one above the other to allow a single means to be used to pin the one-piece double balance spring to the single collet.

7. The one-piece double balance spring according to claim 1, wherein the first and second balance springs have a same angular stiffness.

8. The one-piece double balance spring according to claim 1, wherein the first and second balance springs each have a distinct angular stiffness from the other.

9. The one-piece double balance spring according to claim 1, wherein at least one of the first and second balance springs has at least one silicon dioxide-based part so as to make the one-piece double balance spring mechanically resistant and to adjust a thermo-elastic coefficient thereof.

10. The one-piece double balance spring according to claim 1, wherein an inner coil of at least one of the first and second balance springs has a Grossmann curve.

11. The one-piece double balance spring according to claim 1, wherein the single collet has one metal part to receive an arbour that is driven therein.

12. A timepiece including the one-piece double balance spring according to claim 1.

13. The one-piece double balance spring according to claim 1, wherein the first collet portion, the central collet portion and the second collet portion respectively comprises a central arbour receiving opening.

14. A method of manufacturing a one-piece double balance spring, made from a three layer silicon-based material, the method comprising:

(i) providing a silicon material having first and second layers;

(ii) etching a central collet portion in the second layer;

(iii) securing a third layer on the second layer;

(iv) etching a first balance spring having a first collet portion in the first layer of silicon-based material so that the first collet portion is coaxially mounted on the central collet portion;

and (v) etching a second balance spring having a second collet portion in the third layer of silicon-based material so that the second collet portion is coaxial with the central collet portion, thereby forming the one-piece double balance spring, wherein the first collet portion, the second collet portion and the central collet portion form a single collet wherein the central collet portion is a spacing means defining a space between the first balance spring and the second balance spring.

15. The method according to claim 14, wherein, after step (iv), the method further comprises:

oxidizing the first balance spring, so as to make the one-piece double balance spring more mechanically resistant and to adjust a thermo-elastic coefficient thereof.

16. The method according to claim 14, wherein, after step (v), the method further comprises:

oxidizing the second balance spring, so as to make the one-piece double balance spring more mechanically resistant and to adjust a thermo-elastic coefficient thereof.

17. The method according to claim 14, wherein, prior to step (v), the method further comprises:

selectively depositing at least one metal layer on the third layer to define a pattern of a metal part on the single collet.

18. The method according to claim 17, wherein the selectively depositing includes:

growing a deposition by successive metal layers at least partially over a surface of the third layer so as to form the metal part to receive an arbour that is driven therein.

19. The method according to claim 17, wherein the selectively depositing includes:

selectively etching at least one cavity in the third layer to receive the metal part;

growing a deposition by successive metal layers at least partially in the at least one cavity so as to form the metal part to receive an arbour, which is driven therein.

20. The method according to claim 17, wherein the selectively depositing includes:

polishing the at least one metal layer that is deposited.

21. The method according to claim 14, wherein several of the one-piece double balance springs are made on a same substrate.

* * * * *